US005168667A

United States Patent [19]

Kennedy et al.

[11] Patent Number: 5,168,667

[45] Date of Patent: Dec. 8, 1992

[54] DOOR SYSTEM FOR A MINE STOPPING

[75] Inventors: John M. Kennedy; William R. Kennedy, both of Taylorville, Ill.

[73] Assignee: Jack Kennedy Metal Products and Buildings, Inc., Taylorville, Ill.

[21] Appl. No.: 734,888

[22] Filed: Jul. 24, 1991

[51] Int. Cl.[5] ..... E05C 17/04

[52] U.S. Cl. ..... 49/394; 292/241; 292/204

[58] Field of Search ..... 49/394, 402, 504; 292/13, 228, 240, 241, 244, 204, 80, 87, 209, DIG. 44, DIG. 60

[56] References Cited

U.S. PATENT DOCUMENTS

| | | | |
|---|---|---|---|
| 385,906 | 7/1888 | Chase | 292/204 X |
| 444,826 | 1/1891 | Gloekler | 292/241 |
| 879,811 | 2/1908 | Burgess | 292/204 |
| 1,693,912 | 12/1928 | Worthen | 292/204 |
| 1,704,560 | 3/1929 | Doering | 292/240 |
| 1,897,127 | 2/1933 | Johnson | 292/241 |
| 4,082,331 | 4/1978 | Kennedy et al. | 292/228 |

*Primary Examiner*—Renee S. Luebke
*Assistant Examiner*—Jerry Redman
*Attorney, Agent, or Firm*—Senniger, Powers, Leavitt & Roedel

[57] ABSTRACT

A door system for use in a mine stopping comprises a door frame for installation in the stopping to define a doorway, a door hinged to a first side of the door frame for swinging between an open position and a closed position in which the door closes the doorway, and a latch for latching the door in its closed position. The latch comprises a strike which is secured to a second side of the door frame generally opposite the first side and which has a strike plate portion disposed in the doorway in a plane generally perpendicular to the plane of the doorway and spaced from the second side of the door frame thereby to create a void between the strike plate portion and the second side of the doorway. The strike plate portion has a latching aperture therein. A latching bar is mounted on one face of the door for pivotal movement on an axis generally perpendicular to the door between a latching position in which the latching bar is adapted to project through the latching aperture and into the void to latch the door closed, and a release position in which the latching bar is removed from the latching aperture to permit the door to be opened.

7 Claims, 2 Drawing Sheets

DOOR SYSTEM FOR A MINE STOPPING

BACKGROUND OF THE INVENTION

This invention relates generally to doors for mine stoppings, and more particularly to a door system incorporating a novel latching mechanism for a so-called "man door" for use in connection with masonry and metal mine stoppings.

"Stoppings" are widely used in mines to stop off flow of air in mine passageways, or to inhibit access to the mines, a "stopping" generally being a masonry (e.g., concrete block) or metal wall installed at the entrance of a mine passage. It is often desired that such stoppings be provided with a door, which is referred to as a "man door", for occasional access to the blocked-off passage. A serious problem encountered, however, is providing a latching mechanism for the door which remains effective and operable to latch and unlatch the door in the event the walls of the mine shift or converge, which may result in deformation of the stopping and consequent jamming of the latch or inoperability of the latching mechanism.

Reference may be made to U.S. Pat. No. 4,082,331 for a stopping with a man door using a latching mechanism generally relevant to this invention.

SUMMARY OF THE INVENTION

Among the several objects of this invention may be noted the provision of an improved door system for a mine stopping; the provision of such a door system which incorporates a latch which is designed to operate despite heaving or shifting of the mine walls; the provision of such a door system wherein the latch is pivotable in two directions to effect latching and unlatching of the door; the provision of such a door system wherein it is visibly obvious whether the door needs to be latched closed; the provision of such a door system wherein the latch is operable to latch the door tightly closed without pulling on the door or slamming it closed; and the provision of such a door system which is economical to fabricate.

In general, a door system of the present invention for use in a mine stopping comprises a door frame adapted to be installed in the stopping to define a doorway, a door hinged to a first side of the door frame for swinging between an open position and a closed position in which the door closes the doorway, and a latch for latching the door in its closed position. The latch comprises a strike secured to a second side of the door frame generally opposite the first side and having a strike plate portion disposed in the doorway in a plane generally perpendicular to the plane of the doorway and spaced from the second side of the door frame thereby to create a void between the strike plate portion and the second side of the doorway. The strike plate portion has a latching aperture therein. A latching bar is mounted on one face of the door for pivotal movement on an axis generally perpendicular to the door between a latching position in which the latching bar is adapted to project through the latching aperture and into the void to latch the door closed, and a release position in which the latching bar is removed from the latching aperture to permit the door to be opened.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
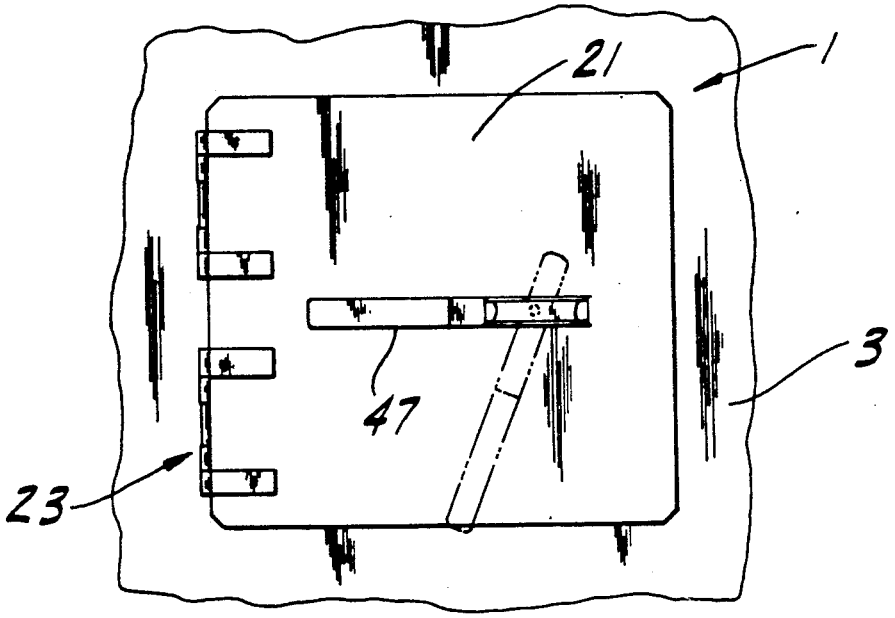
FIG. 1 is a front elevation of a door system of this invention installed in a mine stopping.

Referring to the drawings, a door system 1 of this invention is shown installed in a mine stopping 3, e.g., a concrete block mine stopping. The door system comprises a rectangular door frame, generally designated 5, defining a generally rectangular doorway 7 through the mine stopping. The door frame 5 includes a top frame member 9 at the top of the doorway 7, a bottom frame member 11 at the bottom of the doorway, and first and second side frame members 13, 15 at opposite sides of the doorway. Each of these frame members 9, 11, 13, 15 is of channel shape, and the four channels open outwardly away from the doorway 7 to receive the surrounding wall of the stopping, the arrangement being such that the door frame 5 is held securely in the stopping 3. It will be understood that the door frame may take other shapes without departing from the scope of this invention.

The door system also includes a door 21 having a shape (rectangular as illustrated in the drawings) corresponding to that of the doorway 7. The door has hinge means 23 at an edge thereof (a vertical side edge as illustrated) for mounting the door on the first side frame member 13 of the door frame to swing on a generally vertical axis spaced forwardly from the doorway and adjacent one side thereof between the closed position shown in the drawings in which it engages the front face of the door frame 5 all around the doorway, and an open position swung away from the doorway. A latch generally designated 27 is provided for latching the door closed.

In accordance with this invention, the latch 27 comprises a strike generally indicated at 31 secured to the second side frame member 15, and a metal latching bar generally indicated at 33 which is engageable with the strike 31 in a manner to be described for latching the door 21 in its closed position. The latching bar 33 is mounted on one face of the door (its inside face) for pivotal movement on an axis AX-1 generally perpendicular to the door between a latching position (shown in solid lines in FIG. 2) for latching the door closed, and a release position (shown in phantom lines) permitting the door to be opened. The latching bar 33 comprises a plurality of separate sections 33A, 33B (each of which may be a flat metal bar of rectangular cross section). As shown, one section 33A is relatively short and straight and engageable with the strike 31; the other section 33B is J-shaped to have a bent end portion engageable with the inside face of the door 21 for supporting the latching bar as it pivots on axis AX-1. The two sections are secured together in fixed position relative to one another by means of two fasteners 37 (e.g., nut and bolt fasteners) extending through slots 39 in one of the sections (section 33A in the drawings). This design permits the latching bar sections 33A, 33B slidably to move relative to one another lengthwise of the bar in the event a large force is applied to the bar tending to shorten it, as in the case of a mine convergence, for example. It will be understood that the number of latching bar sections may vary and that other means may be used to permit relative movement of the sections without departing from the scope of this invention. The J-shaped latching bar section 33B is rigidly affixed to a pivot shaft 43 journalled in the door for pivoting of the latching bar 33 between its stated latching and release positions. A handle 47 is provided on the outside face of the door 21 for rotating the pivot shaft 43 on axis AX-1 and thus pivoting the latching bar 33 as needed.

Figure 3:
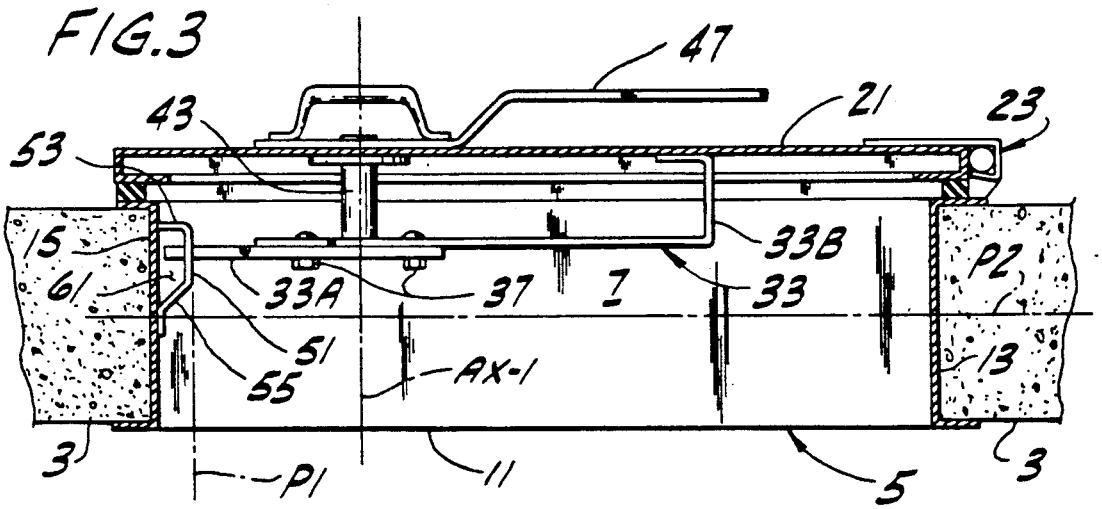
FIG. 3 is a horizontal section taken on line 3—3 of FIG. 2.
Figure 4:
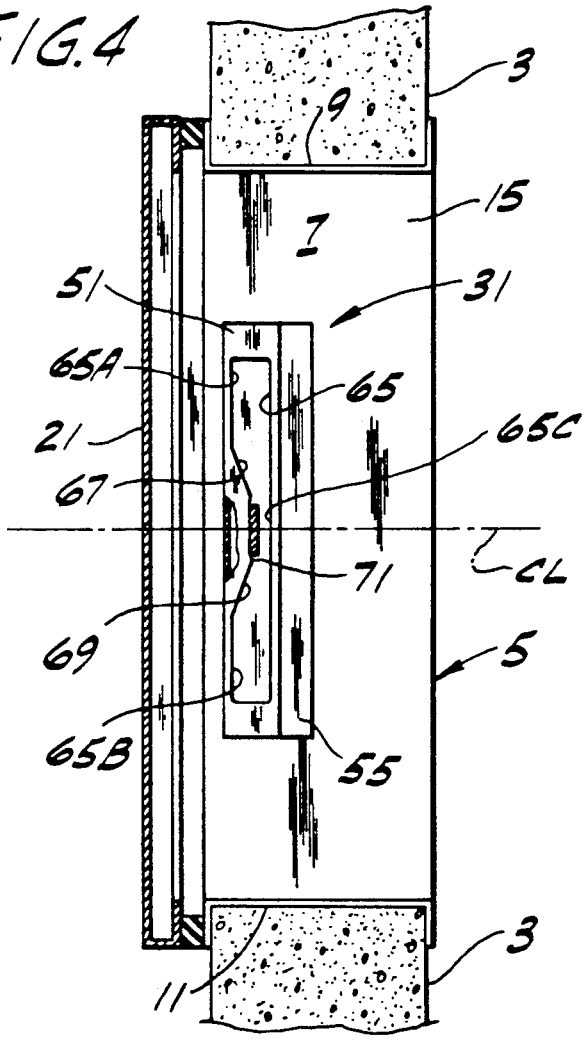
FIG. 4 is a vertical section taken on line 4—4 of FIG. 2.

The strike 31 comprises a one-piece member of generally channel shape (see FIGS. 3 and 4) having a long, rectangular strike plate portion 51 vertically disposed in the doorway 7 in a plane P1 generally perpendicular to the plane P2 of the doorway and generally parallel to the inside face of the side frame member 15, and integral front and rear flanges 53, 55 extending from the strike plate portion and suitably secured (e.g., welded) to the side frame member 15. The arrangement is such that the strike plate portion 51 of the strike 31 is spaced a suitable distance (e.g., ¾ in.) from the side frame member 15 to create a void 61 therebetween. As best illustrated in FIG. 4, the strike plate portion 51 has a latching aperture therein in the form of a slot 65 extending generally parallel to the plane P2 of the doorway (i.e., vertically as shown). The slot 65 has opposite generally rectangular end portions (an upper end portion 65A and a lower end portion 65B) and a narrower intermediate portion 65C having camming edge means engageable by the latching bar 33 (latching bar section 33A, more specifically). This camming edge means includes upper and lower inclined camming edges designated 67 and 69, respectively, connected by a generally vertical holding edge 71 generally at the middle of the slot. The slot 65 is generally symmetrical about the centerline CL shown in FIG. 4. The holding edge 71 of the slot is curved slightly inwardly to hold the latching bar 33 in its latching position against unintentional movement out of such position.

Figure 2:
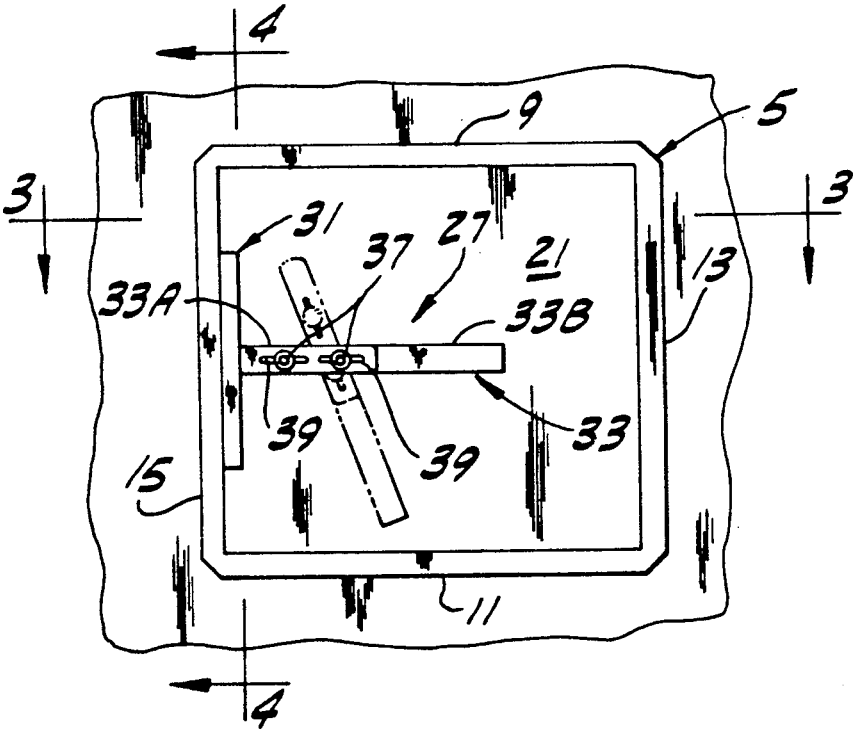
FIG. 2 is a rear elevation of the door system shown in FIG. 1.

The latching bar and slot arrangement is such that when the latching bar 33 is swung from the release position shown in phantom lines in FIG. 2 to a horizontal latching position (shown in solid lines), the latching bar enters the upper end portion 65A of the slot 65 in the strike plate portion 51 of the strike 31 and then slidably engages the upper inclined camming edge 67 of the slot for camming the door closed. The camming edge is so profiled, configured and dimensioned that, when the bar reaches a horizontal position in which it engages the vertical holding edge 71 of the slot, the door 21 is pulled tightly shut against the door frame 5 all around the door frame. In this position, the end of the latching bar 33 projects through the latching aperture and into the void 61 between the strike plate portion 51 and the door frame. To release the door, the latching bar may be pivoted in either direction until it no longer projects through the slot 65 in the strike plate portion 51, at which point the door may be opened. It will be understood that the latching bar may also be swung into engagement with the lower inclined camming edge 69 to latch the door closed.

The symmetry of the disclosed design (with two camming edges 67, 69) allows the latching bar 33 to be pivoted in either direction toward a latching position. Thus, regardless of whether the door is mounted on the left or right side of the door frame 5, the latch can be operated to close the door by pushing the handle 47 down, if this is ergonomically preferred. Moreover, this design allows the latch 27 to operate even if the door frame 5 is distorted (e.g., parallelogrammed) due to mine convergence, for example. Thus, if convergence has caused the door to shift relative to the frame to the point where the latching bar 33 cannot enter one end portion (65A or 65B) of the slot, the latching bar is still likely to be able to be swung to enter the other end portion of the slot for engagement with a respective camming edge (67 or 69) to cam the door closed.

The fact that the strike plate portion 51 is offset from the door frame (creating void 61) rather than recessed into the door frame is also beneficial, since this reduces the possibility that the strike recess or void will become blocked with stopping material in the event of a mine convergence. Moreover, the offset may be relatively deep so that the latching bar 33 can be longer to enable continued operation of the latch even if the separation between the door 21 and door frame 5 substantially increases during shifting or heaving of the mine.

In the event of a mine convergence, the door frame 5 may buckle inwardly into the doorway 7, thereby reducing the dimension from the pivot shaft 43 of the latching bar to the strike 31. This would cause many latching systems to jam and become inoperable; not so with the present invention. In the present design, the slots 39 in the latching bar section 33A allow the latching bar sections 33A, 33B to slide relative to one another and thus decrease the overall length of the bar so that the latch will continue to operate.

It will be observed from the foregoing that the door system of this invention is especially adapted for a mine environment where walls are likely to shift relative to one another, and where it is essential, therefore, that any latch be able to continue to operate despite such shifting.

Generally, the hinge means 23 at the door will be at the side of the doorway in the stopping. However, it will be understood that in some instances the door may be mounted with the hinge means at the top or bottom of the doorway.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A door system for use in a mine stopping, comprising a door frame adapted to be installed in the stopping to define a doorway, a door hinged to a first side of the door frame for swinging between an open position and a closed position in which the door closes the doorway, and a latch for latching the door in its closed position, said latch comprising a strike secured to a second side of the door frame generally opposite said first side and having a strike plate portion disposed in the doorway in a plane generally perpendicular to the plane of the doorway and spaced from said second side of the door frame thereby to create a void between said strike plate portion and the second side of the door frame, said strike plate portion having a latching aperture therein, and a latching bar mounted on one face of the door for pivotal movement on an axis generally perpendicular to the door between a latching position in which the latching bar is adapted to project through said latching aperture and into said void to latch the door closed, and a release position in which the latching bar is removed from said latching aperture to permit the door to be opened.

2. A door system for use in a mine stopping, comprising a door frame adapted to be installed in the stopping to define a doorway, a door hinged to a first side of the door frame for swinging between an open position and a closed position in which the door closes the doorway, and a latch for latching the door in its closed position, said latch comprising a strike secured to a second side of the door frame generally opposite said first side and having a strike plate portion disposed in the doorway in a plane generally perpendicular to the plane of the doorway and spaced from said second side of the door frame thereby to create a void between said strike plate portion and the second side of the doorway, said strike plate portion having a latching aperture therein, and a latching bar mounted on one face of the door for pivotal movement on an axis generally perpendicular to the door between a latching position in which the latching bar is adapted to project through said latching aperture and into said void to latch the door closed, and a release position in which the latching bar is removed from said latching aperture to permit the door to be opened, said latching aperture being in the form of a slot extending generally parallel to the plane of the doorway, said slot having opposite end portions and a narrower intermediate portion, said intermediate portion having camming edge means engagable by the latching bar, the arrangement being such that the latching bar, when pivoted from its release position toward its latching position, is adapted to enter an end portion of the slot and then to engage said camming edge means for camming the door into its closed position.

3. A door system as set forth in claim 2 wherein said camming edge means comprises a pair of camming edges, one of said edges being engageable by said latching bar when it is pivoted in one direction for camming the door closed, and the other of said edges being engageable by said latching bar when it is pivoted in an opposite direction for camming the door closed, said latching bar being adapted to be pivoted in either direction to move the bar from its latching position to its release position.

4. A door system for use in a mine stopping, comprising a door frame adapted to be installed in the stopping to define a doorway, a door hinged to a first side of the door frame for swinging between an open position and a closed position in which the door closes the doorway, and a latch for latching the door in its closed position, said latch comprising a strike secured to a second side of the door frame generally opposite said first side and having a strike plate portion disposed in the doorway in a plane generally perpendicular to the plane of the doorway and spaced from said second side of the door frame thereby to create a void between said strike plate portion and the second side of the doorway, said strike plate portion having a latching aperture therein, and a latching bar mounted on one face of the door for pivotal movement on an axis generally perpendicular to the door between a latching position in which the latching bar is adapted to project through said latching aperture and into said void to latch the door closed, and a release position in which the latching bar is removed from said latching aperture to permit the door to be opened, said latching bar comprising a plurality of separate sections, and means for securing said sections in fixed position relative to one another while permitting movement of the sections relative to one another lengthwise of the bar in the event a large force is applied to the bar tending to shorten it, as in the case of a mine convergence.

5. A door system for use in a mine stopping, comprising a door frame adapted to be installed in the stopping to define a doorway, a door hinged to a first side of the door frame for swinging between an open position and a closed position in which the door closes the doorway, and a latch for latching the door in its closed position, said latch comprising a strike secured to a second side of the door frame generally opposite said first side and having a strike plate portion disposed in the doorway in a plane generally perpendicular to the plane of the doorway and spaced from said second side of the door frame thereby to create a void between said strike plate portion and the second side of the doorway, said strike plate portion having a latching aperture therein, and a latching bar mounted on one face of the door for pivotal movement on an axis generally perpendicular to the door between a latching position in which the latching bar is adapted to project through said latching aperture and into said void to latch the door closed, and a release position in which the latching bar is removed from said latching aperture to permit the door to be opened, and a handle on a face of the door opposite said one face for pivoting the latching bar between its release and latching positions.

6. A door system for use in a mine stopping, comprising a door frame adapted to be installed in the stopping to define a doorway, a door hinged to a first side of the door frame for swinging between an open position and a closed position in which the door closes the doorway, and a latch for latching the door in its closed position, said latch comprising a strike associated with a second side of the door frame, said strike having a latching aperture therein, and a latching bar mounted on one face of the door for pivotal movement on an axis generally perpendicular to the door between a latching position in which the latching bar is adapted to project through said latching aperture, and a release position in which the latching bar is removed from said latching aperture to permit the door to be opened, said latching aperture extending generally parallel to the plane of the doorway and having opposite end portions and a narrower intermediate portion, said intermediate portion having camming edge means engagable by the latching bar, the arrangement being such that the latching bar, when pivoted from its release position toward its latching position, is adapted to enter an end portion of the latching aperture and then to engage said camming edge means for camming the door into its closed position.

7. A door system as set forth in claim 6 wherein said camming edge means comprises a pair of camming edges, one of said edges being engageable by said latching bar when it is pivoted in one direction for camming the door closed, and the other of said edges being engageable by said latching bar when it is pivoted in an opposite direction for camming the door closed, said latching bar being adapted to be pivoted in either direction to move the bar from its latching position to its release position.

* * * * *